US009115436B2

(12) United States Patent
Aylwin Gomez et al.

(10) Patent No.: US 9,115,436 B2
(45) Date of Patent: Aug. 25, 2015

(54) SYSTEM FOR CONFINING AND EVACUATING AEROSOLS OF TWO OR THREE-PHASES

(75) Inventors: Pedro A. Aylwin Gomez, Santiago (CL); Cesar A. Calderon Gutierrez, Antofagsta (CL)

(73) Assignee: New Tech Copper SpA, Santiago (CL)

( * ) Notice: Subject to any disclaimer, the term of this patent is extended or adjusted under 35 U.S.C. 154(b) by 286 days.

(21) Appl. No.: 13/883,932

(22) PCT Filed: Nov. 8, 2011

(86) PCT No.: PCT/CL2011/000067

§ 371 (c)(1),
(2), (4) Date: Jul. 19, 2013

(87) PCT Pub. No.: WO2012/061949

PCT Pub. Date: May 18, 2012

(65) Prior Publication Data

US 2014/0001034 A1 Jan. 2, 2014

(30) Foreign Application Priority Data

Nov. 8, 2010 (CL) ..... 1216-2010

(51) Int. Cl.

| | |
|---|---|
| ***C25B 7/00*** | (2006.01) |
| ***C25C 7/00*** | (2006.01) |
| ***B08B 15/00*** | (2006.01) |

(52) U.S. Cl.

CPC ..... *C25C 7/005* (2013.01); *B08B 15/007* (2013.01); *C25C 7/00* (2013.01)

(58) Field of Classification Search

USPC ..... 205/94

See application file for complete search history.

(56) References Cited

U.S. PATENT DOCUMENTS

| | | | | |
|---|---|---|---|---|
| 3,948,747 | A * | 4/1976 | Cordiano et al. | 204/242 |
| 4,668,353 | A | 5/1987 | Smith et al. | |
| 5,609,738 | A | 3/1997 | Murray et al. | |
| 5,744,018 | A * | 4/1998 | Santoyo et al. | 205/94 |
| 6,054,027 | A * | 4/2000 | Ebert | 204/267 |

FOREIGN PATENT DOCUMENTS

WO 2009/025837 2/2009

OTHER PUBLICATIONS

International Search Report for PCT/CL2011/000067 dated May 6, 2012.

* cited by examiner

*Primary Examiner* — Harry D Wilkins, III

(74) *Attorney, Agent, or Firm* — Morgan, Lewis & Bockius LLP

(57) ABSTRACT

A system to confine a space above an electrolyte in a metal electrowinning cell and to evacuate aerosols of two or three phases that are generated in the space, wherein the system confines in a compartmentalized manner a space above the level of the electrolyte adjoining cathode guides attached to a support structure, the cathodes within their guides, an anodic confiner for each anode, which are mounted directly around them, via their central groove of a length equal to the width of the anode, a pair of flexible projections and a pair of angle profiles of rigid material each of which is located on either side of the anodic confiner, wherein all these elements are linked by a multiplicity of coupling elements.

5 Claims, 10 Drawing Sheets

SYSTEM FOR CONFINING AND EVACUATING AEROSOLS OF TWO OR THREE-PHASES

DESCRIPTION OF WHAT IS KNOWN IN THE FIELD

The production of metal using electrolysis is currently executed mostly by depositing the metal ion on a stainless steel sheet (cathode) by applying a continuous electric current between that cathode and another sheet of metal or a metal alloy (anode) submerged in an aqueous solution, generally acid (electrolyte) of the metal to be deposited. When the anode that is used in insoluble, one speaks of electrowinning the metal from the electrolyte; while when the anode that is used is of the same metal that will be obtained, one speaks of electrolytic refining.

In both cases, once the amount of metal deposited on the cathode has reached an adequate thickness, the circulation of the current is detained, the cathodes are removed from the solution and the deposit must be removed from the stainless steel plate to obtain the product. The superficial deposit of one metal on another for decorative purposes or to protect from corrosion, is also executed in cells with different electrolytes, in which the anode is the metal to be deposited and the cathode the object to be protected or decorated. There is also the case in which the anode is of an insoluble metal or compound and the metal to be deposited comes from the electrolyte in which it is dissolved.

These same processes are also used in the treatment of liquid waste, to weaken their number of cations until they are under the accepted limits for discarding them.

The conditions of operation and of the electrolyte are adjusted with a view to optimizing the deposit on the cathode. Thus the acidity or alkalinity, concentration of metal, temperature and stirring of the solution are adjusted with this in mind. These characteristics of the solution instigate the releasing of gases with micro drops of acids or bases, as the case may be, from the free surface of the electrolyte. The presence of this mist causes health problems among the operators, process-related problems and corrosion of the structures and equipment. Efforts have been made to mitigate these negative effects with different measures, but none of these has solved the problem satisfactorily and some of them have even caused other types of problems, as described below.

The fact that the electrolyte is generally heated at temperatures of about 40 or more degrees Celsius increases its evaporation into the environment which, together with the gases that are released by the electrolytic operation, forms a mist that sweeps along the micro drops and particles contained in it. In an attempt to minimize the free surface of the electrolyte to diminish the evaporation, spheres of expanded polystyrene or another low density material are scattered on the free surface of the electrolyte where they float. These spheres originate other problems, such as, for example, when they are suctioned together with the electrolyte by the circulation pumps they affect the functioning of the pumps as they cover the electrolyte injection distributor, or when they are located between the anodes and cathodes they may produce short-circuits, affecting the normal operation of the process. In Chilean patent application 01869-2002, the use of a solution based on an essence of soap bark that is incorporated into the electrolyte altering its composition has been proposed as a replacement of the spheres of polypropylene or others. Other compounds that have been proposed to reduce the surface tension are the non ionic surfactants as in Chilean Patent Application N° 00328-2006, anti-misting compounds with extremes of sulfate or sulfonate as in Chilean Patent Application N° 02892-2007, addition of anti-foamers as in Chilean Patent Application N° 02684-1999, fluoroaliphatic surfactants as in Chilean Patent Application N° 00580-1995. These compounds generate problems in the extraction process using solvents that is used in the stages of processes prior to electrowinning.

Another type of solution proposed are the covers with or without extraction of the mist by suction, as in Chilean Patent Application N° 02518-2005, that proposes plastic covers that float on the electrolyte and that have a mist trapping element adhered to the free face, or like Chilean Patent Application N° 02451-2007 that considers the use of multiple covers, at the rate of two for each anode, or the thermal cover as in Chilean Patent N° 44803, or the insulating hood immersed in the electrolyte of Chilean Patent N° 36367, or like the one indicated in the U.S. Pat. No. 5,609,738(A), that consists of a system of multiple covers that are located underneath the connecting bars of the electrodes and that sucks in the mist between the level of the electrolyte and said cover located below the conductor bars.

Another tendency is the use of air injection via one side of the cell, together with aspiration via the other side, as indicated in U.S. Pat. No. 5,855,749(A).

Another tendency is to cover the surface of each anode with bags of fibers, sealed to the upper part of the anode above the level of the electrolyte, as in U.S. Pat. No. 6,120,658. Another solution proposed, is the one presented in Patent WO2009/025837 A1 that considers confining the space in which the mist accumulates, limited by the free level of the electrolyte, the faces of the anodes and of the cathodes and two curved upper covers bolted at multiple points to each anode.

A large part of the advantages that it is hoped to obtain with these improvements are diminished by the greater complexity of manufacture along with the higher production and operating costs of those systems, or by the alteration of the electrolyte's composition.

The numbers indicated in the Figures have the following meaning:

1. Flat rigid annular piece.
2. Flexible exterior projection.
3. Flexible interior projection.
4. Rigid angle profile of the support of the flexible right-hand projection.
5. Rigid angle profile of the support of the flexible left-hand projection.
6. Fasteners of the flexible and rigid parts of the Anodic Confiner.
7. Anode
8. Cathode
9. Electrolyte level.
10. Anode support bar.
11. Cathode support bar.
12. Cathode guide of the anode and cathode support structure.
13. Superior longitudinal angle, of insulating material, of the support structure of anodes and cathodes, under which the perforated gas suction and evacuation duct is located.
14. Perforated gas suction and evacuation duct, open on its underside, opening remains submerged in the electrolyte and closed by it.
15. Perforation of the longitudinal suction duct, located in front of each anode of the cell for the electrolytic production of metals.
16. Longitudinal wall of the cell for the electrolytic production of metals.
17. Terminal outlet end to the suction duct of the flow manifold.
18. Open passage of the perforated longitudinal suction duct, connected to the terminal outlet end to the suction duct of the flow manifold.
19. Inferior guide for anode, of the anode and cathode support structure.
20. American coupling type connection that connects the terminal of the longitudinal perforated suction duct with the outlet duct to the Plant's suction collector.
21. Outlet duct to the suction collector.
22. End of the cell's suction duct that connects to the Production Plant's suction system.
23. Metal spring that fixes the Anodic Confiner to the anode and cathode support structure.
24. Mounting and tension adjusting bolt of the Anodic Confiner's fastening spring to the anode and cathode support structure.
25. Mounting and tension adjusting nut of the Anodic Confiner's fastening spring of the anode and cathode support structure.
26. Supplemental piece for adjusting tension of the Anodic Confiner fastening spring to the anode and cathode support structure.
27. Containment compartment of aerosols to be evacuated.
28. Perforated aerosol suction and evacuation duct, closed in its inferior face.
29. Elastic Gripper with double flexible skirt.
30. Exterior flexible skirt.
31. Interior flexible skirt.

DESCRIPTION OF THE INVENTION

Figure 9:
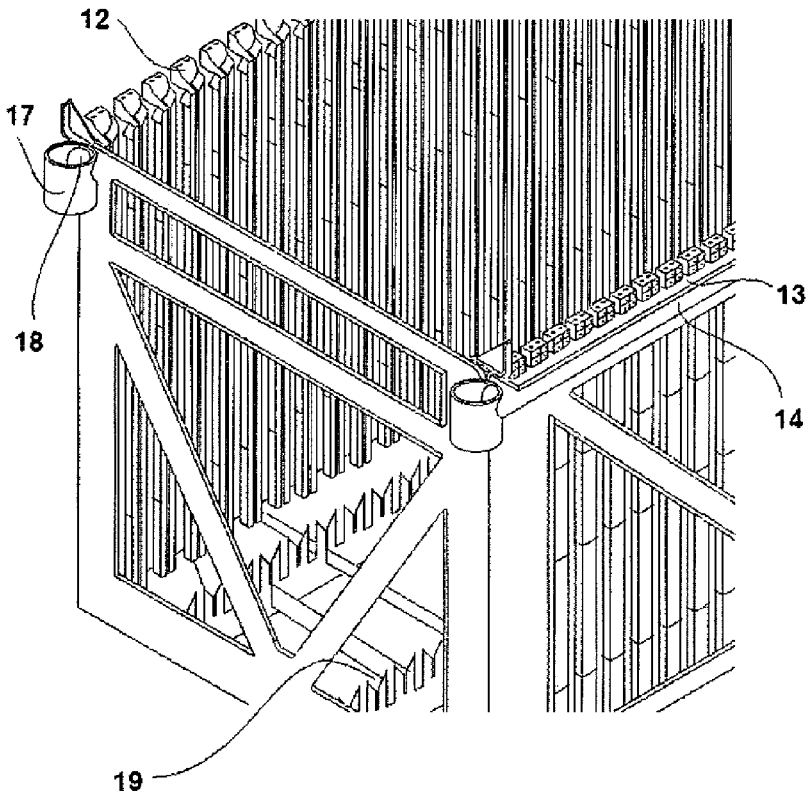
FIG. 9 shows a perspective view of one end of the anode and cathode supporting structure, to which longitudinal perforated ducts have been incorporated on both sides of the structure.
Figure 10:
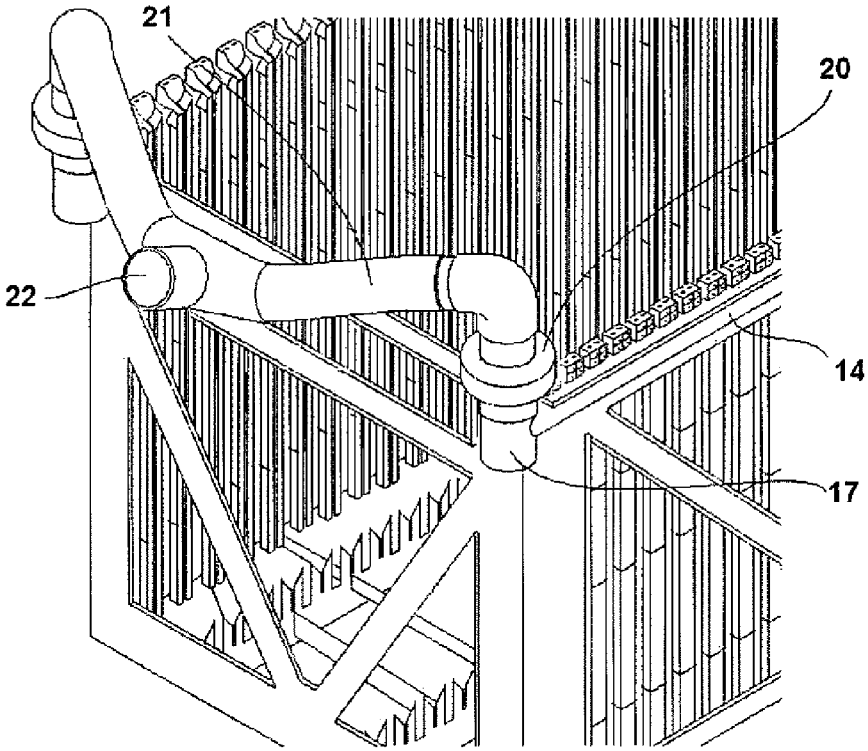
FIG. 10 shows a perspective view of one end of the anode and cathode supporting structure to which two longitudinal perforated ducts have been incorporated to suction the gases and particles that are given off above the level of the electrolyte.

This invention is located in the field of electrolytic deposition of metals, which being of a general application, is especially suited to those cases that use an anode and cathode supporting structure, in the interior of the Cell, such as the one shown in FIGS. 9 and 10. It consists of inserting each anode in the central groove of the Anodic Confiner of FIG. 1, formed by the interior flexible projections (3), by simply sliding the anode (7) in the mentioned groove, after the Anodic Confiner has been attached by means of the spring (23) in the angle (13) of the upper longitudinal beams of the anode and cathode supporting structure.

The idea of this invention is to keep the gases, vapors, mists, aerosols or multiphase flows (gas-liquid, gas-solids, liquid-solid and gas-liquid-solid), that detach from the free surface of the electrolyte from contaminating the work environment of the Production Plant. To do this, this invention acts in two aspects, first to isolate the environment above the production cells, that in one of its materializations uses the Anodic Confiner shown in FIG. 1, formed by one annular rigid flat piece (1), a flexible sheet with exterior projections (2) and interior projections (3) that are supported on the opposite contiguous faces of anodes (7) and cathodes (8), to confine the flows, and secondly suction them before they are incorporated into the environment, by means of longitudinal ducts that are open (14) or closed (28) on the bottom on both sides of the Cell (16), with perforations (15) in front of each end of the anodes, ducts that connect to the Production Plant's Suction and Treatment System (not shown). A particular characteristic of the suction ducts (14) is that their lower face that remains submerged in the electrolyte is open and in contact with the electrolyte, which makes it possible to return to the Cell those liquids that for any reason reach that duct, related mainly with the use of organic extractants in stages prior to the electrowinning.

Figure 7:
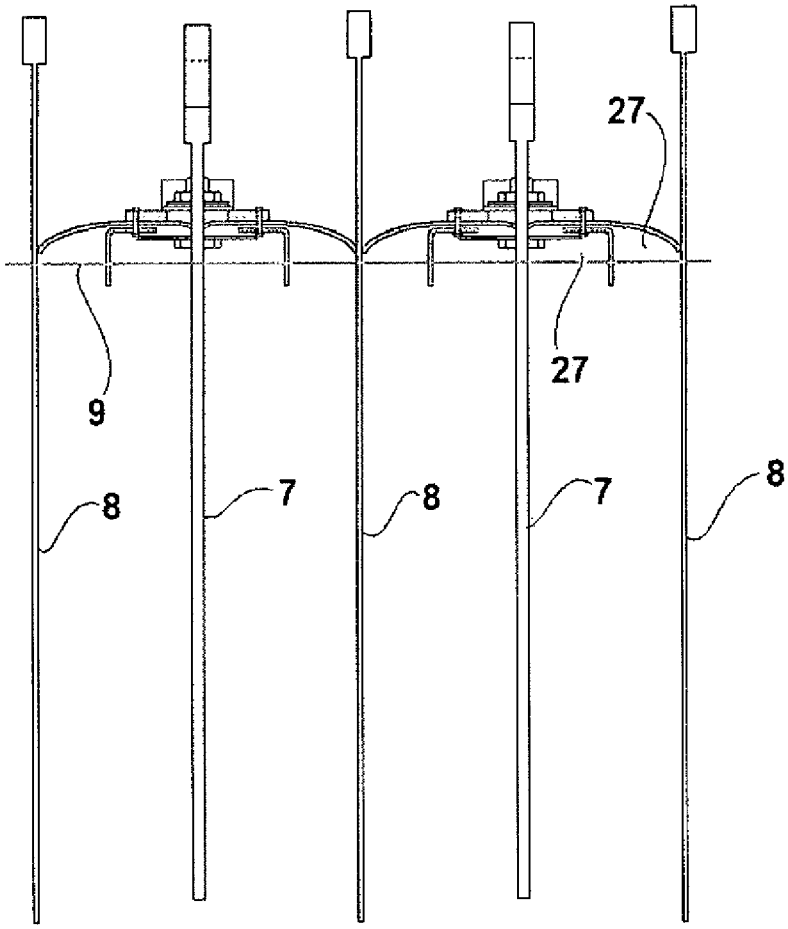
FIG. 7 shows a partial cross-sectional view of an Electrolytic Cell, which shows three cathodes and two anodes with their respective Anodic Confiners with double flexible skirt, placed on the anodes, in operating position.
Figure 8:
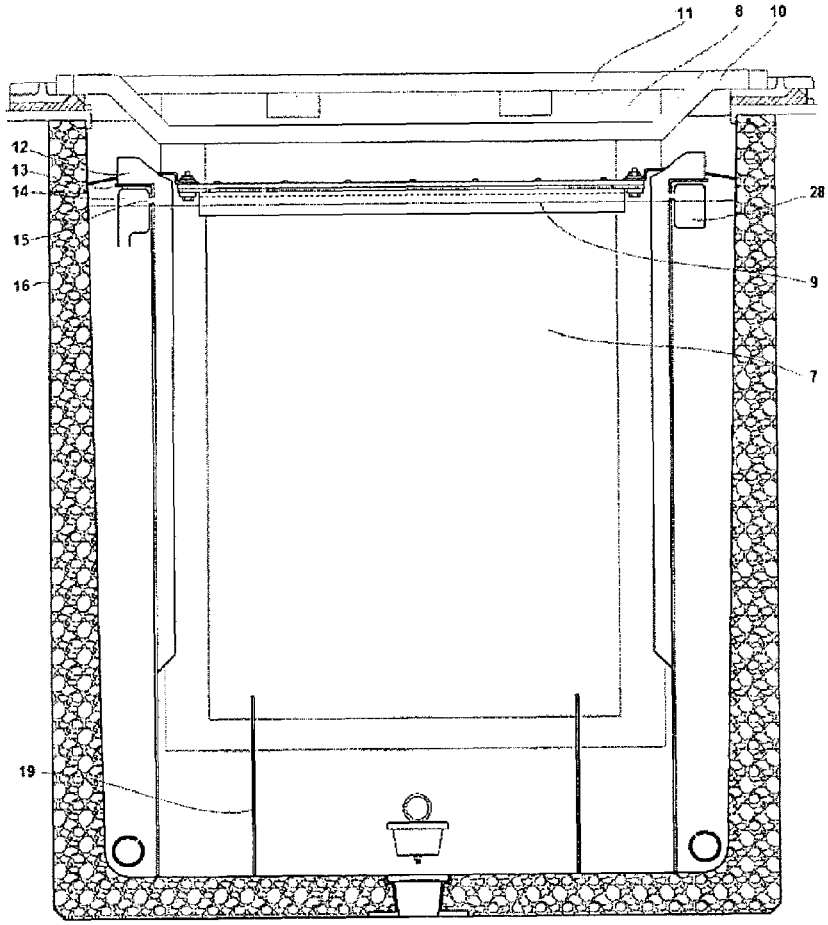
FIG. 8 shows a vertical cross-sectional view of a metal producing electrolytic cell in which one can see an Anodic Confiner in working position, mounted on an anode located in a structure that supports anodes and cathodes.

To isolate the environment above the Cell, in this Invention sealing in a compartmentalized manner is carried out in the space between electrodes contiguous to the Anodic Confiner that is formed by the annular flat Piece (1) with its flexible exterior projection (2), its flexible interior projection (3), its right angle profile of rigid material (4) and its left angle profile of rigid material (5), components that are coupled by multiple coupling elements (6), and is installed directly over the longitudinal angle profile (13) of the anode and cathode support structure, in such a way that the metal spring (23) rests on the upper face of this Profile (13) and the supplemental tension adjusting piece (26) rests on the inferior sloping face of the heads of the cathode guides (12) of the anode and cathode support structure, while the flexible exterior projections (2) rest on the faces of the cathodes (8), as shown in FIG. 7. In another of the materializations of this invention, the Anodic Confiner shown in FIG. 1 is formed by the removable union of two equal and symmetric halves with regard to the central vertical plane of the anodes, which allows removing them without taking out the anodes from the cell.

Figure 1:
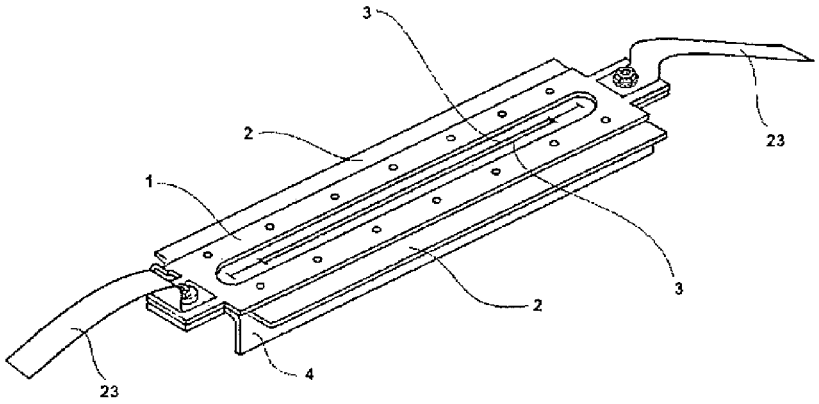
FIG. 1 shows a perspective view of the Anodic Confiner with double flexible skirt.
Figure 3:
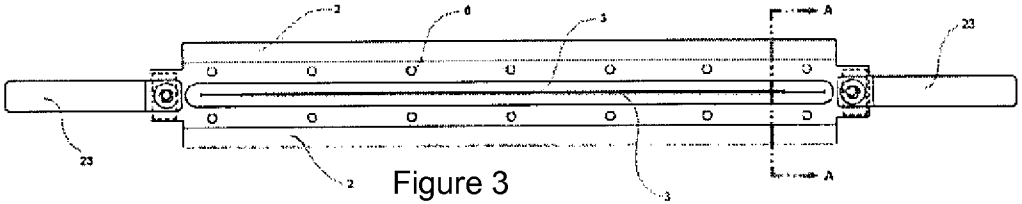
FIG. 3 shows a top plan view of the Anodic Confiner with double flexible skirt.
Figure 2:
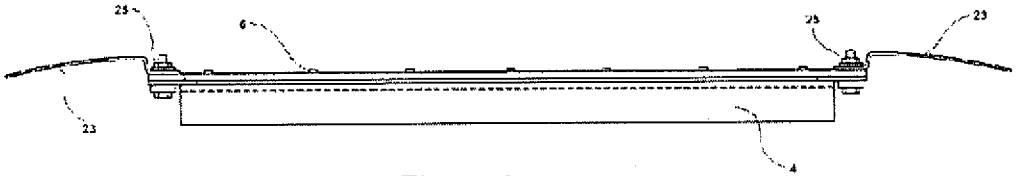
FIG. 2 shows a front view of the Anodic Confiner with double flexible skirt from the outside.
Figure 4:
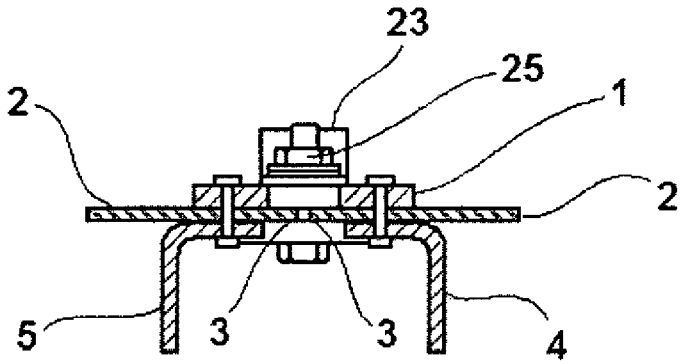
FIG. 4 shows a transversal cross-sectional view by Section A-A, of the Anodic Confiner with double flexible skirt.
Figure 5:
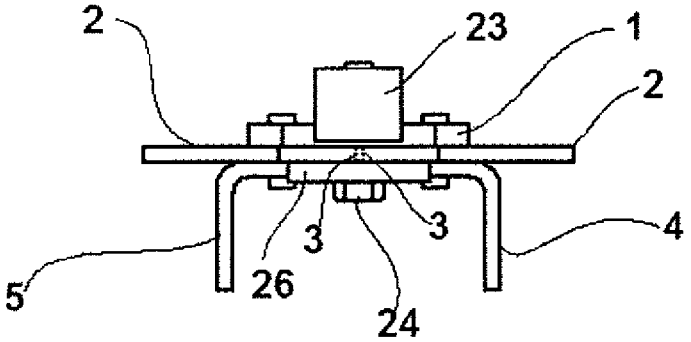
FIG. 5 shows a side view of the Anodic Confiner with double flexible skirt from the outside.
Figure 6:
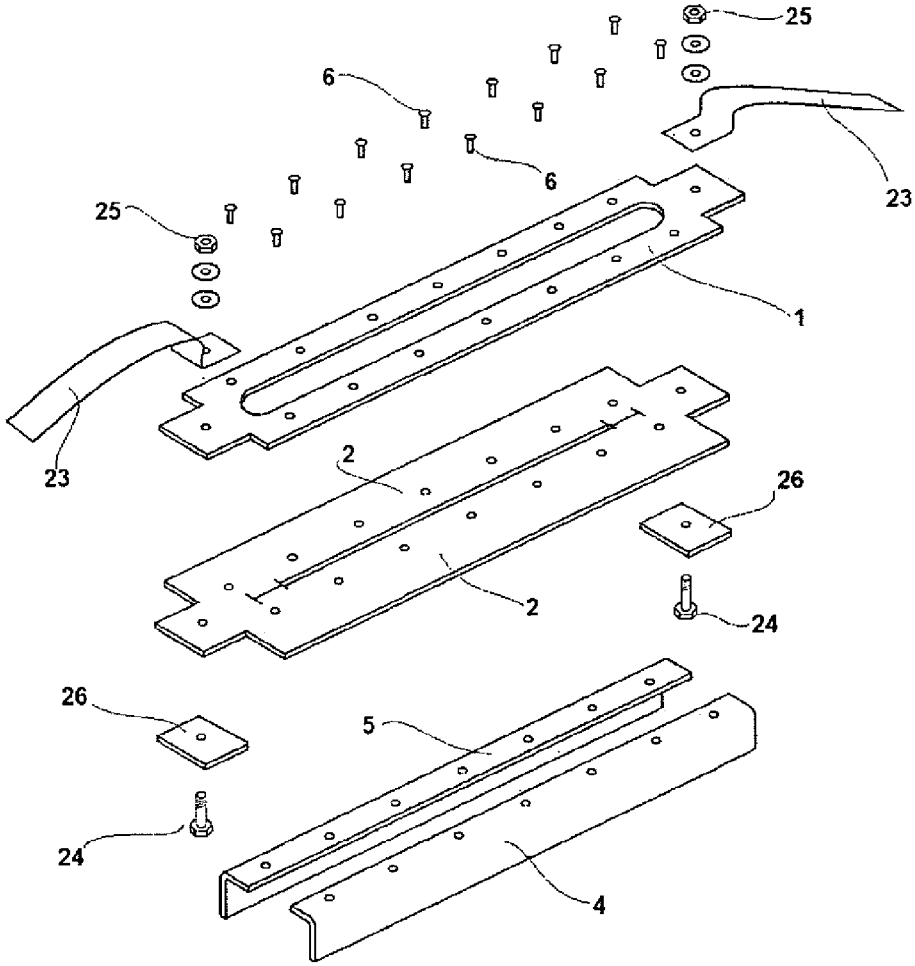
FIG. 6 shows a perspective view of the Anodic Confiner with double flexible skirt, in which the parts that make it up can be appreciated.

The length of the Anodic Confiner of FIG. 1 is equivalent to the width of the Cell in which they will be used, while the total length of the exterior flexible projections (2) is equivalent to the width of the cathodes.

The function of the angle profiles of rigid material (4) and (5), in addition to serving as stiffening elements of the flexible projects (2 and 3), serve at the same time to retain and coalesce the bubbles of mist that are released on the surface of the anode and that ascend vertically towards the surface. Many of the bubbles that ascend towards the surface of the electrolyte break while ascending or after leaving it, from under the angle and the flexible projections (2) and (3), freeing liquid particles that fall and become reincorporated into the electrolyte. This reduces the amount of mist that is trapped between the multiple compartments (27) that are formed between the free surface of the electrolyte (9), the cathodes (8), the anodes (7) and the flexible projections (2) and (3) as illustrated in FIG. 7.

This segmentation of the Cells permits lowering the depression needed for the evacuation of the aerosols, thereby avoiding the crystallization of the copper sulfate that covers the perforations of the perforated suction ducts.

The mist is extracted by suction using perforated ducts that are open underneath (14) or closed (28), or a combination of both, that are located longitudinally on both sides of the Cell and whose perforations (15) confront the positions of the extremes of each anode (7). When an anode and cathode support structure like the one illustrated in FIGS. 9 and 10 is used in the production cell, the perforated ducts (14) or (28) are located under the upper angles (13) of the anode and cathode support structure, angles which in turn serve as support for the cathode guides (12). These Cathode Guides (12), in addition to positioning the cathodes, also serve as support for the ends of the flexible projections (2) and (3), sealing the space and preventing the mist from escaping into the environment through this zone. The perforated ducts (14) or (28) are joined to the head (17), which by means of the American coupling (20) connects to the coupling hose (21) that joins the outlet end (22), that is the connection point to the Production Plant's suction and treatment system, which starts functioning the moment the electric current is connected to the Electrolytic Cell.

When the anode and cathode support Structure is not used in the Production Cell, the free ends of the flexible projections rest on the perforated suction duct, making the seal between the anode and the longitudinal walls of the Cell (16).

Figure 11:
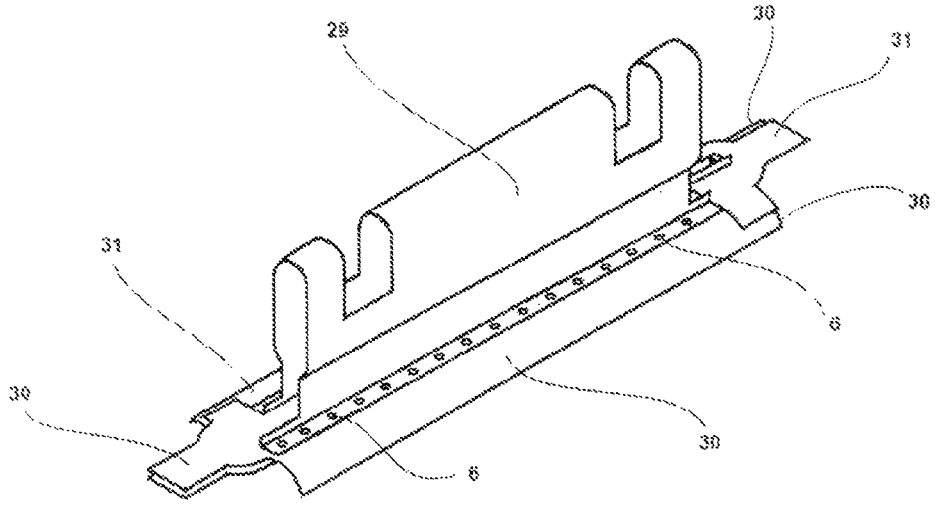
FIG. 11 shows a perspective view of the Anodic Confiner of the Elastic Gripper type with flexible double skirt.
Figure 12:
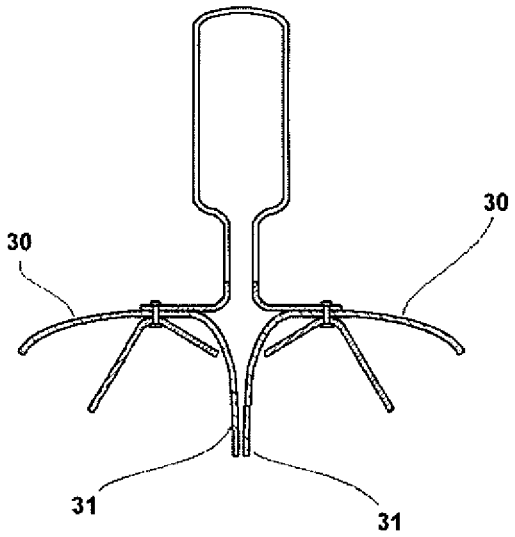
FIG. 12 shows a lateral cross-sectional view from the outside of the Elastic Gripper with flexible double skirt, in the closed position.
Figure 13:
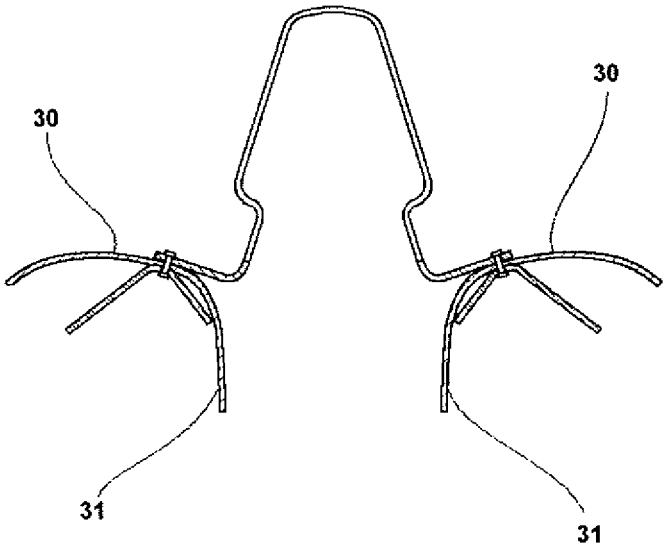
FIG. 13 shows a lateral cross-sectional view from the outside of the Elastic Gripper with flexible double skirt, in the open position, to be introduced on the anode.

The installation of the Anodic Confiners can be executed directly on the Cell or on the anode and cathode support structure, first placing the anodes (7) and then the cathodes. To do this, make sure that the anode supports (10) fit in their connection positions to the capping board and that the inferior ends of the anodes (7) are introduced into the anode guides (19) of the anode and cathode support structure. The anodes must be introduced downward vertically making sure that the lower border of the anode is introduced into the center of the Anodic confiner and that the central interior flexible projections (3) are supported without folds on the faces of the anode. Once an anode has been placed in each Anodic Confiner, the cathodes are introduced making them drop between the anodes, with their Anodic Confiner already installed, thereby the flexible exterior projections (2) of the Anodic Confiner automatically rest homogeneously on both faces of the cathodes (8). In another of its materializations, this invention employs Anodic Confiners of the Elastic Gripper type with double flexible skirt, such as the one shown in FIGS. 11, 12 and 13, characterized in that it can be installed on the anode before or after being placed in the cell and permits removing it without removing the anode from the cell.

EXAMPLE OF APPLICATION

In order to test experimentally the advantages of the anodic confiner to confine the flows that are released from the surface of the electrolyte in a metal electrowinning cell, and without this limiting its applicability, two tests were carried out at laboratory level using the typical industrial electrolyte for electrowinning copper that involves high contents of sulfuric acid, generating mist using lead anodes.

In the first experience, the mist was picked up directly, while in the second experience the mist was collected using the Anodic Confiners, the subject of this invention.

The comparison of the results of both experiences shows that by using the Anodic Confiner, the migration of the mist into the work environment is reduced in more than 90%.

The experiences were carried out under the following conditions:

Current density: 360 A/$m^2$
Voltage: 2.3 V
Electrolysis time: 4 hours
Concentration of Sulfuric Acid (H2SO4): 180 g/l
Concentration of copper (Cu): 45 g/l
Temperature of the Electrolyte: 45° C.
Material of the Anode: Lead (Pb)
Material of the Cathode: Stainless Steel 316 L In the experience in which the Anodic Confiner was not used, an acid mist was obtained with a concentration of $H_2SO_4$ equivalent to 7000 mg/cubic meter of air at normal conditions, in other words at 25° C., and at sea level as 45° of geographical latitude (that is abbreviated as Normal Cubic Meter NCM, in the English language).

In the experience in which the Anodic Confiner was used, an acid mist was obtained with a concentration of $H_2SO_4$ equivalent to less than 1 mg/NCM.

Consequently, it was shown that the use of the Anodic Confiner, the object of this invention, in its preferential embodiment, non-limiting, used in these experiences, is very efficient in reducing the habitual migration of the mist to the work environment in the production of copper by electrowinning.

It is worth remembering that Supreme Decree No. 594 fixes the limit of an acid mist at 0.8 mg/NCM and grants an adjustment for height of 0.55 mg/NCM for Plants that are located in high places, close to the mountains. This tolerance means that when using the Anodic Confiners of this invention, barring exceptions, the limit established by Supreme Decree No. 594 is complied with in Plants at high altitudes.

The invention claimed is:

1. A system to confine a space above an electrolyte in a metal electrowinning cell and to evacuate aerosols of two or three phases that are generated in the space, wherein the system confines in a compartmentalized manner a space above the level of the electrolyte, wherein the system comprises:

an anodic confiner for each anode, which is mounted directly around each anode, via a central groove of a length equal to the width of the anode, wherein the anodic confiner further includes a pair of flexible projections and a pair of angle profiles of rigid material each of which is located on either side of the anodic confiner, wherein the pair of flexible projections and the pair of angle profiles are linked by a multiplicity of coupling elements, in which the length of the flexible projections exceeds the width of the anode to completely cover the active width of a production cell; and longitudinal ducts with perforations above the level of the electrolyte and the lower face of the longitudinal ducts is immersed in the electrolyte.

2. The system, according to claim 1, wherein the fixing relationship between the anodic confiner and the anode is effected by placing the anodic confiner around the anode and only by elastic tightening.

3. The system, according to claim 1, wherein the anodic confiner fixes around the anode, by assembly of two equal and symmetric halves with respect to the central vertical plane parallel to the faces of the anode.

4. The system, according to claim 1, wherein the lower face of the longitudinal ducts is longitudinally open and submerged under the electrolyte, on each side of the cell, in which their upper side is located under the projections of the anodic confiner and the perforations of the longitudinal ducts are directly facing the upper lateral ends of the anodes.

5. The system according to claim 1, wherein the lower face of the longitudinal ducts is closed and submerged under the electrolyte, on each side of the cell, in which their upper side is located below the projections of the anodic confiner and the perforations of the longitudinal ducts are directly facing the upper lateral ends of the anodes.

* * * * *